US006655558B2

(12) United States Patent
Lawrence

(10) Patent No.: US 6,655,558 B2
(45) Date of Patent: Dec. 2, 2003

(54) ORNAMENTAL BENDING DEVICE FOR A BASEBALL CAP TYPE VISOR

(76) Inventor: Lonnie L. Lawrence, 6500 E. Ridge Rd., #102, Odessa, TX (US) 79762

( * ) Notice: Subject to any disclaimer, the term of this patent is extended or adjusted under 35 U.S.C. 154(b) by 0 days.

(21) Appl. No.: 10/193,086

(22) Filed: Jul. 11, 2002

(65) Prior Publication Data

US 2003/0019890 A1 Jan. 30, 2003

Related U.S. Application Data

(60) Provisional application No. 60/308,064, filed on Jul. 26, 2001.

(51) Int. Cl.[7] ..... A42C 1/04
(52) U.S. Cl. ..... 223/14; 223/12; 2/209.13
(58) Field of Search ..... 223/14, 12; 2/209.13; 24/575.1

(56) References Cited

U.S. PATENT DOCUMENTS 4,927,063 A 5/1990 Fricano
5,074,508 A 12/1991 Powers
5,161,719 A 11/1992 Otteson et al.
5,163,589 A 11/1992 Biehl
5,533,652 A 7/1996 Levin
5,634,575 A 6/1997 Scharrenberg
5,908,146 A 6/1999 Levin
6,196,428 B1 3/2001 Robak
6,234,367 B1 5/2001 McCallister

*Primary Examiner*—John J. Calvert
*Assistant Examiner*—James G. Smith
(74) *Attorney, Agent, or Firm*—Law Office of Tim Cook P.C.

(57) ABSTRACT

An ornamental visor-bending device with a strand that is bent, formed and cut, comprises a laterally arched member running substantially from one side of a baseball cap type visor to the other side. The device further includes end members on each end of the strand which releasably attach and constrain the edges of the opposing sides of the visor and force the central portion of the visor to conform to an arch or other useful shape. The visor-bending device may be worn with the visor on the head of the user to maintain the bend of the visor. The laterally arched strand may itself be made ornamental with or without additional ornamentation attached. The end members are ornamental and have additional ornamentation attached.

24 Claims, 2 Drawing Sheets

ORNAMENTAL BENDING DEVICE FOR A BASEBALL CAP TYPE VISOR

This application claims priority from Provisional U.S. Patent Application Ser. No. 60/308,064 filed Jul. 26, 2001.

BACKGROUND OF THE INVENTION

1. Field of the Invention

The present invention relates generally to the field of devices for bending and shaping a baseball cap visor or bill, and more particularly, to a device to permanently hold and maintain the baseball cap type visor in a desired shape as it is worn. The visor-bending device, when applied to a visor, also ornamentally decorates the visor.

2. Description of Prior Art

Various ways to bend and shape the visor of a ball cap have been used for some time. Such a visor's distinguishing characteristic typically includes a fabric covered canopy made of cardboard or plastic designed to shade the eyes of the wearer. The visor is affixed to a portion of the rim of the ball cap. Other similar visors are affixed to hat gear that have no dome for the head of a user, but rather are affixed to a rim that fits around the user's head over the eyes, the crown of the user's head being exposed. Preferably, the visor of a hat serves the functional purpose of shading and protecting portions of a person's face from the sun, wind, rain and other elements.

The visor is usually made of a material to give it stiffness. The visor is often manually bent to a desired curvature according to the tastes of the user. Some users use different sizes of rubber bands to bind the visor in a certain shape for later wear, once the rubber bands are removed. Another method of shaping the visor is to insert the visor into a visor-bending device. The wearer then slips the visor out of the bending device and puts on the cap. The curvature, however, over time gets out of shape as the hat is either worn or otherwise tossed around. Maintaining the exact curvature the user would like is a constant effort.

Unfortunately, there are no known visor-bending devices that can maintain a certain curvature of a visor while being worn as well as stored, and ornamentally decorate the visor. The present invention provides a device for a precise bending and shaping of a baseball cap type visor to a desired curvature or other shape that can then be maintained as the visor is worn while also presenting a pleasing and esthetic enhancement to the visor.

Many devices for baseball cap type visor shaping exist in the art. For example, U.S. Pat. No. 5,533,652 and U.S. Pat. No. 5,908,146 both issued to Levin relate to a cap visor shaping, transport, storage, washing and/or display device including a lateral member with two end members extending up to retain a cap visor with the lateral or central member being arched upwardly in the center with the end members forming a shoulder to receive both sides of a cap visor. An elastic strap extends over the top of the visor to bend the visor to a desired curvature.

U.S. Pat. No. 6,234,367 issued to McCallister teaches a similar device for bending a cap visor. The device includes first and second interconnected block members each having an S-shaped portion upwardly extending from the outer edge thereof that forms a groove on the upper surface for receiving a side edge of a cap visor. A threaded shaft extends from one of the block members and alternately continues with a threaded bore on the other block member so that rotation of the screw in the shaft moves the blocks closer or farther apart. A user can bend a cap visor to a desired curvature by securing the visor within the block grooves and moving the blocks a select distance until the desired curvature is achieved.

U.S. Pat. No. 5,634,575 issued to Scharrenberg relates to another apparatus and method of reforming cap visors. The device includes a visor shaped upper member having a pair of adjustable retention plate strips that snap to each other for bending and retaining a cap visor. The pair of elongated retention plate devices are attached to the upper visor member that is laid on top of the visor. The visor member then bends the cap visor as the two retention plate strips are attached together at the desired juncture the user demands.

U.S. Pat. No. 4,927,063 issued to Fricano relates to a combination cap hanger and cap visor press that includes spring loaded gripping members with a curved form to receive a cap visor. The curvature of the gripping members and the force of the spring combine to press the cap visor into a desired shape. The device has a hanging member portion that is formed in the gripping member to allow the cap to be hung by the visor.

U.S. Pat. No. 5,074,508 issued to Powers is basically a retention clip conveniently located within a vehicle to insert the cap visor and support the cap out of the way while not being worn.

U.S. Pat. No. 5,163,589 issued to Biehl relates to a cap press including a cylindrical base portion for stretching the body of the cap and a visor clamp with a pair of jaws operably connected to press the cap visor into a predetermined shape.

U.S. Pat. No. 5,161,719 issued to Otteson et al relates to a cap shaping and drying device having a mesh support frame for the crown and a wire framed projection member for supporting and shaping the visor and is particularly useful for allowing the crown and cap to keep the shape the user intends after washing and drying time.

U.S. Pat. No. 6,196,428 issued to Robak is essentially another cap visor shaping device that consists of a rectangular arched body with a molded hollow sleeve on each end and a molded hanger type hook in the center portion of the body. On one end is a cylindrical sleeve for inserting the visor of a cap and on the other end, is another cylindrical sleeve to insert the visor of another cap for shaping, and lastly the device has a hanger feature between the two cylinders to hang the hat on a clothes hanger rod.

Thus, many different devices exist in prior art for bending and shaping the baseball cap type visor, although none address the significant advantage of permanently maintaining the shape of a baseball cap type visor while at the same time having an additional significant advantage of being suitable to be worn attached to the visor to present a pleasing and aesthetic look to the eye. The present disclosure provides a device for a precise bending and shaping of a baseball type cap visor to a desired curvature or other shapes which can then be maintained as the visor is worn or not while also presenting a pleasing and esthetic enhancement to the baseball cap type visor.

SUMMARY OF THE INVENTION

The present invention addresses this need in the art by providing a slender arc of a conformable material which may be shaped by the user and then retain its shape. The arc of conformable material, such as for example metal, further includes end pieces on either end of the arc which adapted to clip securely onto the side edges of a common baseball cap type visor. The ends are further adapted, if desired, to receive an ornamentation, such as for example the emblem of the user's favorite team, and the like. The arc may be adapted to reside underneath the visor, so that only the ornamentation is visible to the casual observer, or the arc may fit over the visor or bill of the cap, so that ornamentation may be placed anywhere along the side-to-side aspect of the bill.

It is therefor an object of this invention to provide a device when applied to a baseball cap type visor that is lightweight, inexpensive and unobtrusive, suitable to be worn with the visor head gear.

It is a further object of this invention to provide a device when applied to a baseball cap type visor which will afford the user a way to make old, worn out, flimsy visors feel new and stiff again while being worn.

It is yet another object of this invention to provide a device when applied to a baseball cap type visor that feels good and tight to the user's head when worn.

It is also an object of this invention to provide a device when applied to a baseball cap type visor makes the visor bendable to almost any bend the user desires, not just an arch, as it is worn.

It is an object of this invention to provide a device when applied to a baseball cap type visor that will afford the user a way to precisely and permanently maintain the exact bend of a baseball type cap visor the user desires when worn or not.

It is yet another object of this invention to provide a device when applied to a baseball cap type visor which does not have to be attached every time the user stores the baseball cap type visor or detached every time the user decides to wear the visor head gear.

It is still further an object of this invention to provide a device when applied to a baseball cap type visor that when worn on the baseball cap type visor has a pleasing, aesthetic, ornamental look to the eye.

It is still another object of this invention to provide a device for a baseball cap type visor that may have interchangeable ornamental fastening members that can be replaced with other ornamentally designed members the user desires.

It is still another object of this invention to provide a device for a baseball cap type visor that may have interchangeable ornamental fastening members that can be replaced with other ornamental designed members used for advertising.

DETAILED DESCRIPTION OF PREFERRED EMBODIMENTS

Figure 2:
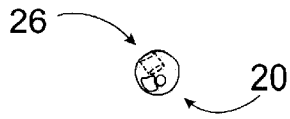
FIG. 2 is a detail view of a typical ornament which finds application with the visor-bending device, in this case a sphere.
Figure 3:
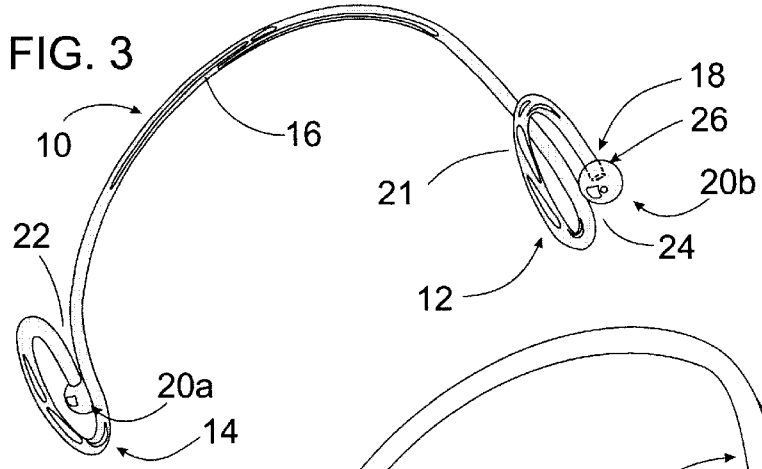
FIG. 3 is an isometric view of a preferred embodiment of the device with an ornament attached.
Figure 4:
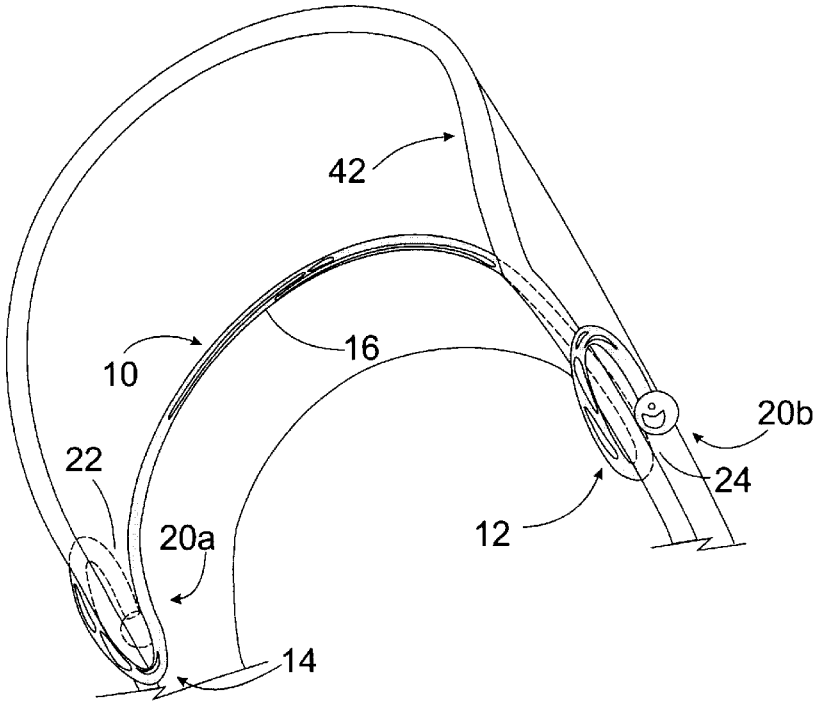
FIG. 4 is an isometric view of a preferred embodiment of an ornamental baseball cap type visor-bending device of FIG. 3 showing the preferred insertion of the baseball cap type visor edges into the device.

FIGS. 1 through 4 depict a presently preferred embodiment of an ornamental visor-bending device 10 of the present invention. The device 10 comprises an ornamental, laterally arched strand 16 with end members 12 and 14 formed out of each end of the ornamental laterally arched strand 16. The end members are preferably mirror images of one another and together they provide an ornamental fastening mechanism to attach the device to a visor of a ball cap, as shown in FIG. 4.

The ornamental laterally arched strand member 16 and opposing end members 12 and 14 of the visor-bending device 10 are preferably bent and cut units made out of an extruded metal material, most preferably from thin, tempered steel wire stock or other such treated and blended metal alloys that lend themselves to a stiff but resilient property as well as molding, bending and cutting ease. Many other materials could lend themselves to such resiliency properties of molding, bending and cutting ease and thus the preference of tempered steel should not limit the scope of the invention. For example, the device may be made of flexible metal, spring steel, flexible alloy, spring alloy, flexible polymer, polyolefins, polyamides, polyethylene, polypropylene, and copolymers and terpolymers thereof, or rubbery polymer. While the manufacture of the ornamental visor-bending device 10 by a multi-step process of using an extruded material of a particular stock, that is subsequently bent and cut is preferred, it can also be appreciated that the visor-bending device 10 can also be thermoformed or stamped or a combination thereof, such as is the case with a corrugated carbide fiber plastic or other similar plastic or nylon raw materials and such materials are well within the scope of the present invention.

The ornamental fastening mechanism end members 12 and 14 show a particular embodiment of the visor-bending device 10 that preferably comprises a substantially spiral-shaped fastening loop 21 of FIG. 3, defining a gap with a void 22 between the rung of the spiral and the end of the laterally arched strand, thus rendering a tension grip fastening structure comprising an open top clip 24 that allows the insertion of the edge of a baseball cap type visor 42. According to this particular preferred embodiment of the invention, the clip 24 allows the insertion of a baseball cap type visor edge 42 and thus the clip 24 is preferably slightly narrower than the thickness of a baseball cap type visor edge 42. This structure yields a gap with a void 22 between the rung of the spiral and the end of the laterally arched strand, the edge 42 of the visor filling the void 22. Thus, the ornamental spiral-shaped fastening mechanisms 12 and 14 are expandable at the clip 24 so that the ornamental fastening mechanism end members 12 and 14 can be fitted and frictionally grip a baseball cap type visor edge 42 tightly enough that the baseball cap type visor edge 42 is not accidentally pulled out of void 22 in a substantially radial direction during normal use.

The width and thickness of the ornamental spiral-shaped fastening mechanisms 12 and 14 are sufficient to hold the baseball cap type visor edge 42 against a reasonable tugging force as might be experienced during installation of the baseball cap type visor edge 42, yet flexible enough to permit the ornamental spiral-shaped fastening mechanisms 12 and 14 to be attached to and released from the baseball cap type visor edge 42 as needed. The size and flexibility of ornamental spiral-shaped fastening mechanisms 12 and 14 may be such that "one size fits all" baseball cap type visor edges 42, or visor-bending device 10 can be made with ornamental spiral-shaped fastening mechanisms 12 and 14 of different size gaps of void 22 and clips 24, depending upon the thickness and width of the baseball cap type visor, as desired.

Figure 1:
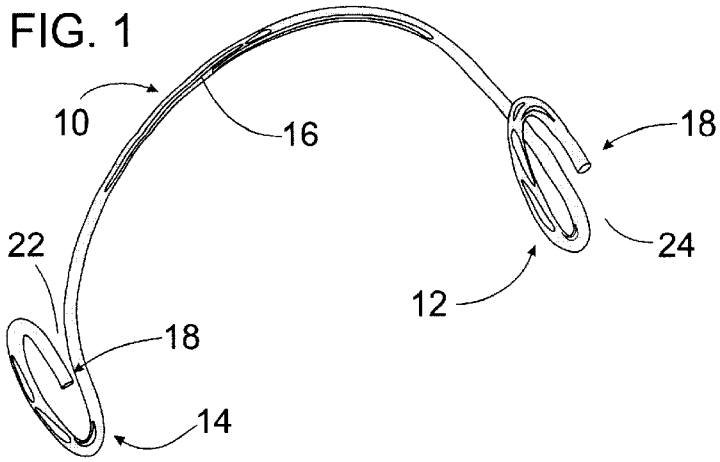
FIG. 1 is a perspective view of the present invention showing an ornamental baseball cap type visor-bending device.

Considering the many different variables of styles and types of fastening mechanisms available, the ornamental fastening mechanism end members 12 and 14 in FIGS. 1, 3–4 are conveniently shown as ornamental spiral-shaped fastening mechanisms, and are only one preferred embodiment of many different styles and types capable of gripping the baseball cap type visor edge. The ornamental coil or spiral-shaped fastening mechanisms 12 and 14 of FIG. 1 provide for attachment of many different style ornaments 20, as shown in FIG. 2, here shown as a small sphere or ball. Considering the scope of the invention, many designs are capable of attaching to the ornamental fastening mechanisms 12 and 14 and will become part of the function of the ornamental fastening mechanisms 12 and 14 such as dice, footballs, figurines and a multitude of other designs too numerous to list. In FIG. 2 however, is shown a typical ornamentation of the present invention, depicting an ornamental sphere or ball 20 to represent a vast number of other ornamentations (not shown) for the visor-bending device 10. The ornamentation 20 of FIG. 2 has a small hole 26 fabricated in the surface of the sphere 20, yet other ornamental designs may also have a hole to facilitate the insertion of the male ends 18 of the ornamental fastening mechanism end members 12 and 14, as is FIG. 3. The hole 26 of FIG. 2 serves as a typical type of fastening mechanism to attach one style ornament 20 of FIG. 2 to the male ends 18 of the ornamental spiral-shaped fastening mechanisms 12 and 14 respectively, as shown in FIGS. 1 and 3. The hole 26 of FIG. 3 substantially serves as a receptacle to insert the male ends 18 of ornamental spiral-shaped fastening mechanisms 12 and 14 and is designed slightly larger in diameter to receive and grip the male ends 18 of the ornamental spiral-shaped fastening mechanisms 12 and 14. After insertion of the male end 18 of the ornamental spiral-shaped fastening mechanisms 12 and 14 of FIG. 3, the hole 26 desirably frictionally grips the tip end of the ornamental spiral-shaped fastening mechanisms 12 and 14 tightly enough that the male ends 18 of the ornamental spiral-shaped fastening mechanisms 12 and 14 do not accidentally pull out. Other fastening mechanisms besides the hole 26 of FIG. 2 could also be used, such as threaded holes to receive complementary threaded male ends of the ornamental fastening mechanisms 12 and 14 of FIG. 1.

As previously described, the ornamental laterally arched strand member 16 in FIG. 1 is preferably an extrusion-type strand, preferably bent and cut from stock in various lengths and widths and arched in various degrees of shape. One may choose to obtain a raw stock metal or plastic material that is already extruded in the correct dimensions which can then be bent and cut. Once bent and cut, the ornamental laterally arched strand member 16 of FIG. 1 is preferably similar in size and appearance to a thin wire and preferably has a cross-sectional width of approximately 0.07 inches and a length of approximately 9 to 11 inches depending on the width of the visor intended. The actual size of the laterally arched strand member 16 of the visor-bending device 10 of the present invention is bent and cut to fit the width and arch of different size baseball cap type visors 42 of FIG. 4.

The ornamental laterally arched strand member 16 with molded ornamental spiral-shaped fastening mechanism end members 12 and 14 of FIGS. 1, 3–4 receives the opposite edges on each side of the baseball cap type visor 42 that are inserted into the clip 24 of the ornamental spiral-shaped fastening mechanisms 12 and 14, filling the gap of void 22, as shown in FIG. 4. A preferred embodiment of the visor-bending device 10 of FIG. 4 arches substantially under the baseball cap type visor 42, the laterally arched strand member 16 pushing the central portion of the baseball cap type visor 42 in an arch shape while grasping and pulling the edges of the baseball cap type visor 42 in the opposite direction after insertion in the ornamental spiral-shaped fastening mechanisms 12 and 14. By grasping the baseball cap type visor edge 42 on the left or right side, with one hand, the user can first grasp one of the ornamental spiral-shaped fastening mechanisms 12 or 14 with the other hand, making sure that the clip 24 of one of the ornamental spiral-shaped fastening mechanisms 12 or 14 in FIG. 3 aligns with the edge of the visor 42, and then push the ornamental spiral-shaped fastening mechanism 12 or 14 laterally onto the baseball cap type visor edge 42 into the clip 24 filling the gap of void 22 in FIG. 4. Once one edge is inserted into one of the ornamental spiral-shaped fastening mechanisms 12 or 14, the user may grasp the other ornamental spiral-shaped fastening mechanisms 12 or 14 with the free hand and slide it onto the baseball cap type visor's opposite edge 42 by the same process as the first fastening mechanism 12 or 14.

Although the ornamental baseball cap type visor-bending device 10 is shown in FIGS. 1, 3–4 as having ornamental spiral-shaped fastening mechanisms 12 and 14 the ornamental fastening mechanism end members 12 and 14 of the laterally arched strand 16 may have other design fastening mechanisms not shown, yet having similar function as the present disclosure, and should not limit in scope the disclosed significant advantages of the invention. For example, the ornamental fastening mechanism end members just as easily could have a C-shape style fastening mechanism end member (not shown) similar to a nose ring, with the ornamentation 26 of FIG. 2 attached to one open end of the C-shape fastening mechanism end member, with the ornamental laterally arched member 16 as one continual strand of the other end of the C-shape fastening mechanism end member, then conversely, the same C-shape fastening mechanism end member located on the opposite end of the ornamental laterally arched strand.

Figure 5:
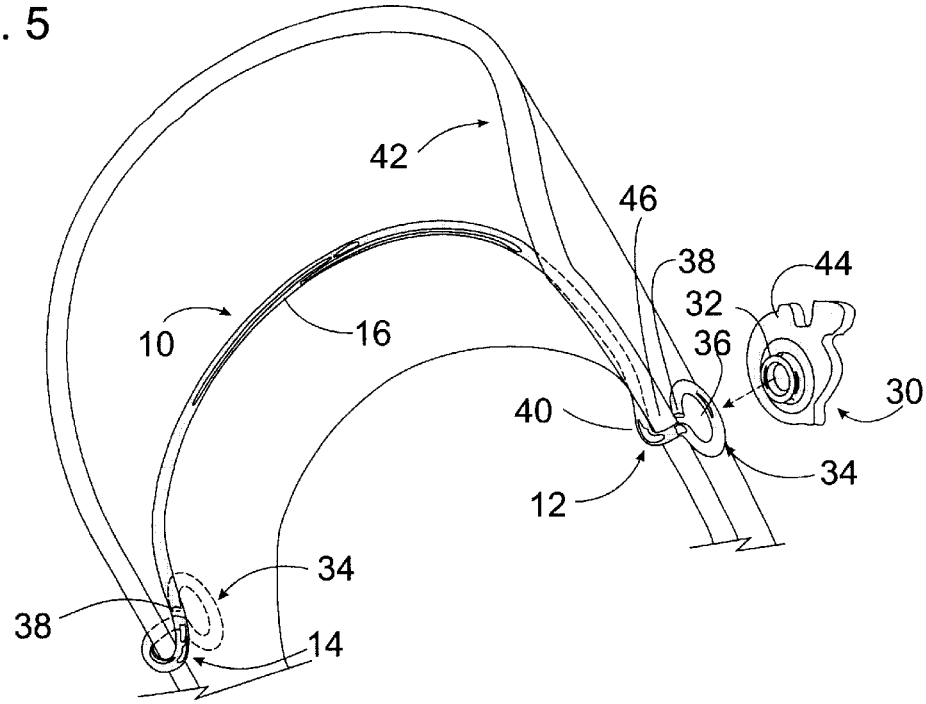
FIG. 5 is an isometric view of another preferred embodiment of the device as seen from the underside of a baseball cap visor and further including an eyelet fastening mechanism to receive ornamentation.

FIG. 5 depicts another visor-bending device 10 illustrating a preferred embodiment having end members 12 and 14 with differently designed but similarly effective snap-on type ornamental fastening mechanism end member structures that will be described later in more detail, but are well within the scope of the present invention, and are specifically intended to be a part of the visor-bending device, the design of the fastening mechanism not limiting the scope of the invention. Furthermore, while the visor-bending device 10 is described herein in relation to a preferred embodiment having shaped or bent ornamental fastening mechanism end members 12 and 14 out of the ends 18 of a laterally arched strand member 16 as in FIG. 1, ornamental fastening mechanism end members may also be releasable, the ornamental fastening mechanism end members attachable to the ornamental laterally arched member, and as such, are not one continuous bent-to-form unit of the ornamental laterally arched strand member, but rather affixed onto the ends of the laterally arched strand member, attached in a myriad of ways that would still render the ornamental visor-bending device as effective and pleasing to the eye, and can also be used within the scope of the present invention.

Additionally, the strand member may also take on other ornamental characteristics, such as having a Florentine finish or having more curves and bends to produce different designs but at the same time not reduce the significantly specific functions the ornamental visor-bending device is intended to do. As mentioned above, many different sizes and shape variables are well within the scope of the present invention.

FIG. 5 depicts another preferred embodiment of an ornamental baseball cap type visor-bending device 10 with ornamental eyelet fastening mechanisms 34 formed on each end of the ornamental laterally arched strand 16, the first approximately one inch of the ends 38 of the ornamental laterally arched strand 16 first bent into eyelet shaped fastening mechanisms 34 to releasably attach an ornamental plate 30 by means of a snap-on stud fastening mechanism 32 located and affixed to the backside 44 of the ornamental plate 30. After first forming the eyelet shaped fastening mechanisms 34 on the ends 38 of the laterally arched strand 16, the laterally arched strand 16 is further bent at a location 40, in the immediate proximity to the first bend that formed the eyelet 34, forming a void 46 to form U-shaped fastening mechanisms 12 and 14. The ornamental U-shaped fastening mechanisms 12 and 14 are fashioned to accept and grip the baseball cap type edge 42 inside the void 46 as shown in FIG. 5. Finally, the combination dashed line and arrow in FIG. 5 shows the direction and location for the placement of the male snap-on type fastening mechanism 32 affixed on the backside 44 of the ornament 30 which is inserted and attached to the eyelet shaped fastening mechanism 34.

In FIG. 5, the ornamental laterally arched strand member 16 and U-shaped ornamental fastening mechanism end members 12 and 14 and eyelet fastening mechanism 34 are preferably a bent tempered wire, all of one continuous strand. The ornamental plate 30 is preferably made of a material that can be stamped, cut, engraved, painted or molded and can render any number of ornamental objects and can have a reflective surface as well, or a surface for advertisement. The ornamental plate 30 is preferably slightly larger in length and width than the eyelet shaped fastening mechanisms 34 but could be the same size or substantially larger.

Other ornamentation that allows for the visor-bending devices to be used as ornamental pieces includes the laterally arched strand member which may have an ornamental affixed design on the laterally arched strand surface, either painted, cut, molded or affixed to. Additionally, the ornamental plate 30 could be an elongated, stretchable fabric running substantially along the top surface of the baseball cap type visor. Furthermore, the laterally arched strand member may also render itself to different shapes other than an arch, for example the strand member may define the shape of an upside-down "V" or squared "C" shape, the laterally arched strand member being more than able to be bent into a user's desired configuration and hold the visor in that shape without losing resiliency. Of course, too much bending and tampering with the shape will eventually weaken the material of the laterally arched strand enough to render it less effective, but it is assumed the user will be aware of such abuse.

Figure 6:
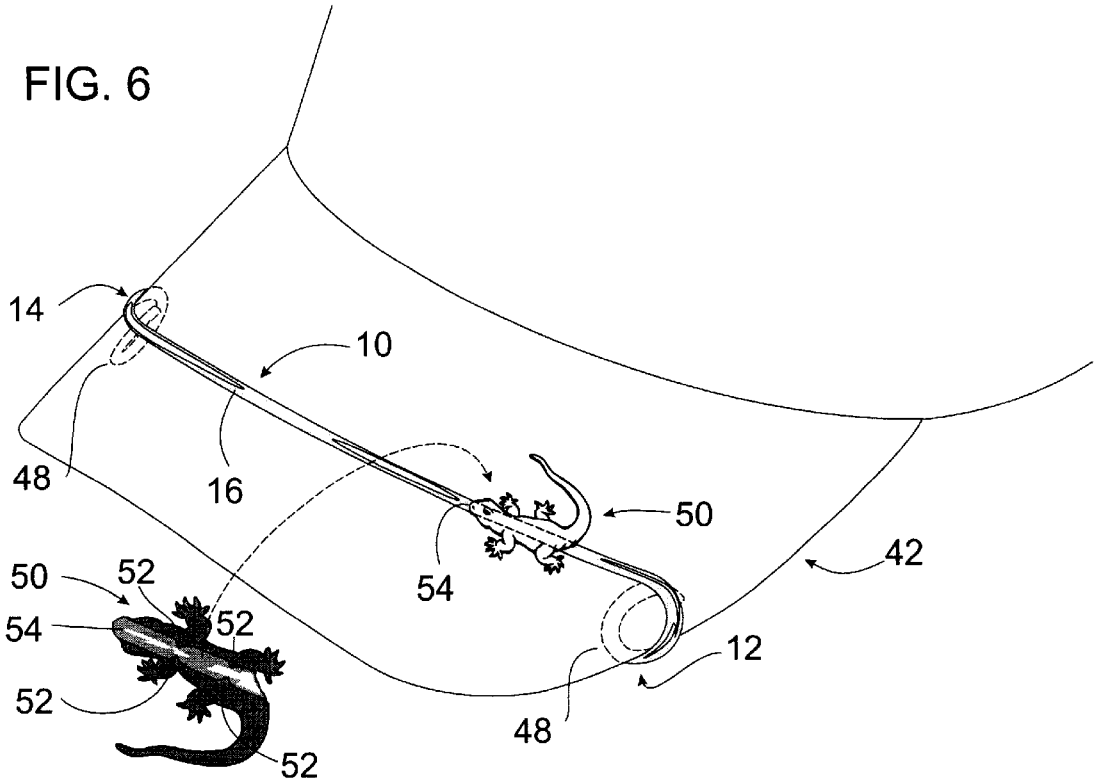
FIG. 6 is an isometric view of yet another preferred embodiment of the device positioned on top of the visor.

FIG. 6 depicts the ornamental laterally arched strand 16 with ornamental spiral-ring shaped end members 12 and 14, each looking like one ring of the many rings of a spiral binding of a note-book bent in an inward direction inside the arch of the laterally arched strand 16 to form clips 48 to receive the edges of the visor 42 so that the laterally arched strand 16 is visible on top of the baseball cap type visor. FIG. 6 is a preferred embodiment showing an ornamental baseball cap type visor-bending device 10 of the present invention with ornamental spiral-like fastening mechanism end members 12 and 14 gripping the edges of a visor, shaped out of the ends of the ornamental laterally arched strand 16 that is positioned on top of the visor, and including a typical ornament 50, in this case a figurine shaped like a lizard that affixes to the ornamental laterally arched strand 16 via a groove or channel 54 with small prongs 52 molded into the ornament 50 to grip the ornamental laterally arched strand 16, the combination dashed line and arrow showing the direction and place of attachment of the ornamental figurine 50 by flipping the ornament over onto the laterally arched strand 16 and snapping it in a desired position. The groove or channel 54 is preferably large enough in diameter to snap onto and fit snugly against the circumference of the ornamental laterally arched strand 16 and be secured enough that the user may use a finger to pry the ornament off if need be.

The ornamental visor-bending device 10 and ornaments 20 and 30 of FIGS. 1 through 6 with ornamental laterally arched strand members 16 and ornamental end members 12 and 14 can be packaged for resale as a single unit, or, the visor-bending device members 12, 14, 16, 20 and 30 individually. They can then be shipped as components to pre-assemble in a factory or sent to the retail outlets as a finished product.

Other alterations and modifications of the invention will likewise become apparent to those of ordinary skill in the art upon reading the present disclosure, and it is intended that the scope of the invention disclosed herein be limited only by the broadest interpretation of the appended claims to which the inventors are legally entitled.

I claim:

1. A visor bending device, adapted to attach to a visor defining a top surface, a bottom surface, a left edge and a right edge, the device comprising:

a bendable lateral strand of predetermined length adapted to conform to a surface of the visor and to retain a desired shape for the visor; and an end fastening member on each end of the lateral strand, each end fastening member having a structure releasably attachable to a respective left and right edges of the visor, wherein at least one end fastening member comprises a coil.

2. The device of claim 1, wherein the coil is expandable, defining a gap between the coil and the lateral strand to receive the edge of the side of a baseball cap type visor.

3. The device of claim 1, wherein the end fastening members and lateral strand are one continuous piece formed from a material selected from the group consisting of flexible metal, spring steel, flexible alloy, spring alloy, flexible polymer, polyolefins, polyamides, polyethylene, polypropylene, and copolymers and terpolymers thereof, and rubbery polymer.

4. The device of claim 1, wherein the end fastening members and lateral strand are joined together.

5. The device of claim 4, wherein the lateral strand has at least one end fastening member releasably attachable on at least one end of the lateral strand.

6. The device of claim 1, wherein at least one end fastening member comprises at least one additional ornament member releasably attachable to at least one end fastening member.

7. The device of claim 1, wherein at least one end fastening member comprises a U-shaped fastening member that further comprises an eyelet fastening mechanism formed onto the U-shaped fastening member.

8. The device of claim 7, wherein the U-shaped member is expandable, defining a void with a clip between the lateral main strand and the eyelet fastening mechanism to receive and frictionally hold the edge of the side of a baseball cap type visor.

9. The device of claim 7, wherein the eyelet fastening mechanism defines a void to receive and hold an additional ornament member.

10. The device of claim 6, wherein the ornamentally shaped member is a three dimensional object.

11. The device of claim 6, wherein the ornamentally shaped member is a sphere.

12. The device of claim 6, wherein the ornamentally shaped member is a plate.

13. The device of claim 6, wherein the ornamentally shaped member is formed of a metal.

14. The device of claim 6, wherein the ornamentally shaped member is formed of a polymer.

15. The device of claim 6, wherein at least one end fastening member and the additional ornamentally shaped member comprise one molded unit.

16. The device of claim 1, wherein the lateral strand comprises an additional ornamentally shaped member on the strand.

17. The device of claim 16, wherein the additional ornamentally shaped member on the strand is a figurine.

18. The device of claim 16, wherein the additional ornamentally shaped member on the strand is one molded unit.

19. The device of claim 16, the additional ornamentally shaped member on the strand is releasably attachable.

20. The device of claim 1, wherein the lateral strand further defines an ornamental design.

21. The device of claim 1, wherein the lateral strand is positioned beneath the visor.

22. The device of claim 1, wherein the lateral strand is positioned above the visor.

23. The device of claim 16, wherein the additional ornamentally shaped member on the strand is a three dimensional object.

24. A visor bending device, adapted to attach to a visor defining a top surface, a bottom surface, a left edge and a right edge, the device comprising:

a bendable lateral strand of predetermined length adapted to conform to a surface of the visor and to retain a desired shape for the visor;

an end fastening member on each end of the lateral strand, each end fastening member having a structure releasably attachable to a respective left and right edges of the visor, wherein at least one end fastening member comprises a U-shaped fastening member; and an ornament member fixedly attached to the end fastening member.

* * * * *